US010173091B2

(12) United States Patent
Chen

(10) Patent No.: US 10,173,091 B2
(45) Date of Patent: Jan. 8, 2019

(54) FOLD DOWN TRAMPOLINE

(71) Applicant: Samuel Chen, Hong Kong (CN)

(72) Inventor: Samuel Chen, Hong Kong (CN)

( * ) Notice: Subject to any disclaimer, the term of this patent is extended or adjusted under 35 U.S.C. 154(b) by 0 days.

(21) Appl. No.: 15/438,082

(22) Filed: Feb. 21, 2017

(65) Prior Publication Data

US 2017/0239504 A1 Aug. 24, 2017

Related U.S. Application Data

(60) Provisional application No. 62/299,387, filed on Feb. 24, 2016.

(30) Foreign Application Priority Data

Dec. 30, 2016 (CN) ..... 2016 2 1475238 U

(51) Int. Cl.
*A63B 5/11* (2006.01)
*A63B 71/02* (2006.01)

(52) U.S. Cl.
CPC ..... *A63B 5/11* (2013.01); *A63B 71/022* (2013.01); *A63B 2210/50* (2013.01)

(58) Field of Classification Search
CPC ..... Y10T 403/4017; Y10T 403/58; Y10T 403/581; Y10T 403/598; Y10T 403/7079; Y10T 403/7088; A63B 5/11; A63B 2210/50
See application file for complete search history.

(56) References Cited

U.S. PATENT DOCUMENTS 7,322,911 B2 * 1/2008 Webber ..... A63B 23/02 482/142
7,367,745 B2 * 5/2008 Lu ..... B62K 27/12 301/111.06
7,468,020 B2 * 12/2008 Lai ..... A63B 5/11 16/324
7,862,479 B2 * 1/2011 Goldwitz ..... A47B 3/002 482/27
8,062,238 B2 * 11/2011 Lindblad ..... A61H 1/0218 482/144
9,750,972 B1 * 9/2017 Liu ..... A63B 22/0076
2005/0207836 A1 * 9/2005 Melander ..... E02F 3/3627 403/324

* cited by examiner

*Primary Examiner* — Megan Anderson
(74) *Attorney, Agent, or Firm* — Clement Cheng

(57) ABSTRACT

A trampoline includes a trampoline frame including a trampoline frame ring supported by a trampoline frame. A trampoline bed is supported across the trampoline frame. The trampoline frame is foldable. Enclosure poles are oriented in a vertical orientation when the enclosure poles are in a deployed position. One or more hinge joints connect the enclosure poles to the trampoline frame. The enclosure poles are mounted to the trampoline frame ring at the hinge joints. The enclosure poles fold inward to a horizontal position when the enclosure poles fold to a folded position. The enclosure poles may overlap each other when folding to the folded position.

9 Claims, 11 Drawing Sheets

FOLD DOWN TRAMPOLINE

The present invention is a non-provisional of U.S. provisional application 62/299,387 filed Feb. 26, 2016, entitled Fold Down Trampoline by inventor Samuel Chen, the disclosure of which is incorporated herein by reference.

The present invention also claims priority from China application 201621475238.0 filed Dec. 30, 2016, entitled A Trampoline with Separate Automatic Detent Structure by applicant Xiamen Dmaster Health Technology Co., Ltd., now assigned to Sportspower Limited, the disclosure of which is incorporated herein by reference.

FIELD OF THE INVENTION

The present invention is in the field of folding frame trampolines.

DISCUSSION OF RELATED ART

A variety of different trampoline enclosures can fold-down. These trampoline enclosures are used for improving safety of users to help them not fall out of the trampoline jumping area. For example, in U.S. patent publication 2012/0252634 published Oct. 4, 2012 by inventor Masato Ikegami entitled Trampoline With Collapsible Enclosure Assembly, an enclosure assembly has support arches that fold-down, the disclosure of which is incorporated herein by reference. Ikegami also discloses that hinge joints can be used.

As shown in FIG. 1, the folded-type trampoline proposed by the prior art Taiwan patent publication document TW M285374 operates the second frame rod 12 from an unfolded position to a folded position after clamping the pivot 121 of the second frame rod 12 to the pivot connection groove 111 of the corresponding first frame rod, and finally inserts the locating assembly 13 into the corresponding locating hole 122 to fix the spacing and the trampoline is unfolded. However, the trampoline bed has a strong elastic contraction force. This causes several problems. First, if not completely clamped to the corresponding pivot connection groove 111, the pivot 121 will eject from the pivot connection groove 111 when the second frame rod 12 is operated from the unfolded position to the folded position. Second, if the force interrupts when the second frame rod 12 is operated from the unfolded position to the folded position, the elastic contraction force of the trampoline bed will clamp the first frame rod 11 and the second frame rod 12 and thus users may be clamped by the trampoline frame like a fly in a Venus fly trap like what is happened with some Consumer Product Safety Commission recalled trampolines. Finally, even if the second frame rod is operated to the folded position, the locating assembly 13 needs to be inserted into the locating hole 122. During this process, force must be exerted to ensure the second frame rod 12 is constantly in this folded position, otherwise the second frame rod 12 will be pulled by the trampoline bed, bounce back and hurt the users, which is indeed very dangerous. As is shown in FIG. 2 and FIG. 3, when the second frame rod 12 is operated from the unfolded position to the folded position, force needs to be exerted to ensure the second frame rod 12 is located in this folded position. Then, a locating assembly 13 is inserted into a locating hole 122 to fix the spacing, during which users face the same risk of injury.

Therefore, a variety of different trampoline frames are made to be foldable. In U.S. Pat. No. 4,452,444, issued Jun. 5, 1984, inventor Schulze, Jr., discusses a "rebound exerciser" or trampoline that is foldable, the disclosure of which is incorporated herein by reference. Schulze, Jr. describes "a hinge with a locking means that secures symmetrical sections together. The locking member have substantially U-shaped rod having two threaded ends which are adapted to be inserted through said pair of spaced-apart, aligned bores when said sections are in said second extended position; and a pair of double threaded nuts adapted to be mated with said threaded ends when said threaded ends are inserted through said pair of bores so as to releasably secure said sections in said second extended position." Additionally, U.S. Pat. No. 7,094,181 published Aug. 22, 2006, discusses a foldable trampoline. Inventor Hall describes legs and hinges configured to provide lateral flexibility in the framework, to thereby decrease the stress imposed on the hinges, thereby increasing the life of the hinges, when the trampoline is folded. The same inventor Hall in U.S. Pat. No. 6,648,799 published Nov. 18, 2003, discusses a Foldable Trampoline in which the "pivoting means include a pair of hinges and a set of hinges. The pair of hinges are disposed on opposite ends of the frame such that a pivot axis is along a diametrical line of the circular frame, including the pair of hinges. In such a configuration, the hinges permit the frame to be moved between a substantially planar open position and a folded position."

Also, Wang et. al. discusses in U.S. Pat. No. 6,939,270 entitled Foldable Trampoline published Sep. 6, 2005, two pairs of overlapped lug portions to have two through holes provided thereon opposite to the shaft pin, so that a safety pin may be inserted into the through holes when the frame sections are in a fully extended position. The invention entitled titled Foldable Trampoline and Conversion Kit in U.S. Pat. No. 7,862,479 by inventor Goldwitz, published Jan. 4, 2011, discusses hydraulic cylinders connecting the base frame member to the center hinge, which, "may assist in controlling the movement of the frame assembly from a collapsed state to an expanded state or vice-versa. For example, the hydraulic cylinders may substantially or completely assist in preventing the frame assembly from "snapping" shut thereby causing injury to the user when moving the frame assembly from a collapsed state to an expanded state or vice-versa."

Instead of a snapping hinge, inventor Tacquet in U.S. Pat. No. 6,110,074 published Aug. 29, 2000, discusses, "opening the trampoline for use involves using a crank to turn the screw and doing that, the pushrods will push against the thrusts and the distance between the ends of the adjacent frame sections will be increased. The more the user turns the screw, the more the distance between the ends of the adjacent frame sections increases, and when that distance increases, it also increases the diameter of the whole frame as well as its distance from the mat. As the mat is linked to the frame by means of the springs, the length of the springs is increased and the force applied via springs increases proportionally to their length. The maximum tension of the mat is obtained when the screws have been fully turned."

Inventor Lai in U.S. Pat. No. 7,468,020 published Dec. 23, 2008, entitled Foldable Trampoline, discusses a safety feature in the summary of invention as, "When the coupling shaft is extended into the coupling notch, and the foldable frame unit is operated to move from the folded state to the unfolded state, the securing shaft is guided along the guiding edge of the first end part of the first frame section and is subsequently received in the securing notch such that the coupling shaft and the securing shaft cooperate with the first end part of the first frame section to secure the foldable frame unit in the unfolded state."

U.S. Pat. No. 4,824,100 entitled Opposed Rebounding Exercise Device, published Apr. 25, 1989, by inventor Hall et al. discusses a safety feature where each sleeve is slidable along a leg of a U-shaped frame and is locked in desired position by a pair of set screws and that are threaded through the sleeve and into engagement with the leg. In U.S. Pat. No. 4,415,151 entitled Collapsible Rebound Exercise Device, published Nov. 15, 1983, inventor Daniels discusses a trampoline with framework that includes a first pair of opposed hinges disposed for permitting the framework to be moved between a substantially planar open position and a folded or collapsed position, and including a lock arrangement for retaining the framework in the open, or use, position.

SUMMARY OF THE INVENTION

A trampoline of the present invention has a frame that can fold to a flat folded position from a deployed position. A trampoline with a folding frame has a frame supporting a bed tensioned by springs across the frame. The frame has horizontal frame members including a horizontal frame member formed as a frame unit. The frame unit has a first frame rod and a second frame rod. The first frame rod connects to the second frame rod. Two locating assemblies pass the joint of the first and the second frame rods and multiple support rod bases where the first and the second frame rods extend downwardly. The first frame rod extends and includes two first ends.

A retaining plate is mounted to the first frame rod. The retaining plate has a pair of plate sides. The pair of plate sides extend downwardly from the retaining plate. The retaining plate is mounted on the first ends of the first frame rod. Each retaining plate has an end face formed toward a front of the two first ends. Two clamping grooves are indented at a pair of end faces. The pair of end faces is formed on the pair of plate sides. Two pivot connection grooves extend upwardly into a pair of undersurfaces. The pair of undersurfaces are formed on the lower surface of the pair of plate sides. Two stop grooves that extend laterally from the two pivot connection grooves. Two pivots are mounted on the second frame rod and configured to engage the two stop grooves. A locating hole is formed on the second frame rod at a side of the second frame rod. The locating hole is configured to receive a locating assembly that engages the two clamping grooves.

Optionally, the trampoline with folding frame may have a retaining plate with stop blocks on the lower surface. Each stop groove has an upper groove wall and a lower groove wall is set opposite to an upper groove wall. A groove sidewall is configured between the upper groove wall and the lower groove wall. Each upper groove wall, lower groove wall and groove sidewall is load bearing and may abut the frame rods. The second frame rod also includes two auxiliary supports connected to their corresponding auxiliary support bottom edges and auxiliary support pivots. The retaining plate has plate sides that are parallel to each other. The second frame rod also includes threading slots connected to corresponding locating holes. The two locating assemblies each comprise a rod and multiple fixture blocks that protrude and extend towards the outer periphery of the rod. Each rod and its corresponding fixture block respectively respond to their respective threading slot.

Each locating assembly also includes a bumper in an arc shape. An end of each bumper is connected to a first side end of the corresponding rod. The other end of each bumper is detachably nested in a second side end of the corresponding rod. Each retaining plate may have an inverted U-shape cross-section. The support rod bases have joint pipes connected to an outer periphery of the first frame rod and the second frame rod and legs connected to the joint pipes. The joint pipes are welded to the first frame rod and the second frame rod.

Through the design of the pivot connection grooves and the stop grooves, the locating assemblies can be first inserted into the corresponding locating holes. After the pivot is clamped to the corresponding pivot connection groove, the second frame rod is operated from the unfolded position to the folded position. Then the locating assemblies are respectively inserted into the corresponding locating holes and clamping grooves. Moreover, the pivot is clamped to the corresponding stop groove to complete the unfolding action. Hence, this design can enhance the operational safety of the product.

The trampoline also includes a trampoline frame including a trampoline frame ring supported by a trampoline frame. A trampoline bed is supported across the trampoline frame. Enclosure poles are oriented in a vertical orientation when the enclosure poles are in a deployed position. One or more hinge joints connect the enclosure poles to the trampoline frame. The enclosure poles are mounted to the trampoline frame ring at the hinge joints. The enclosure poles fold inward to a horizontal position when the enclosure poles fold to a folded position. The enclosure poles may overlap each other when folding to the folded position. In this way, the entire trampoline can fold for shipping or storage including the poles and frame.

Figure 1:
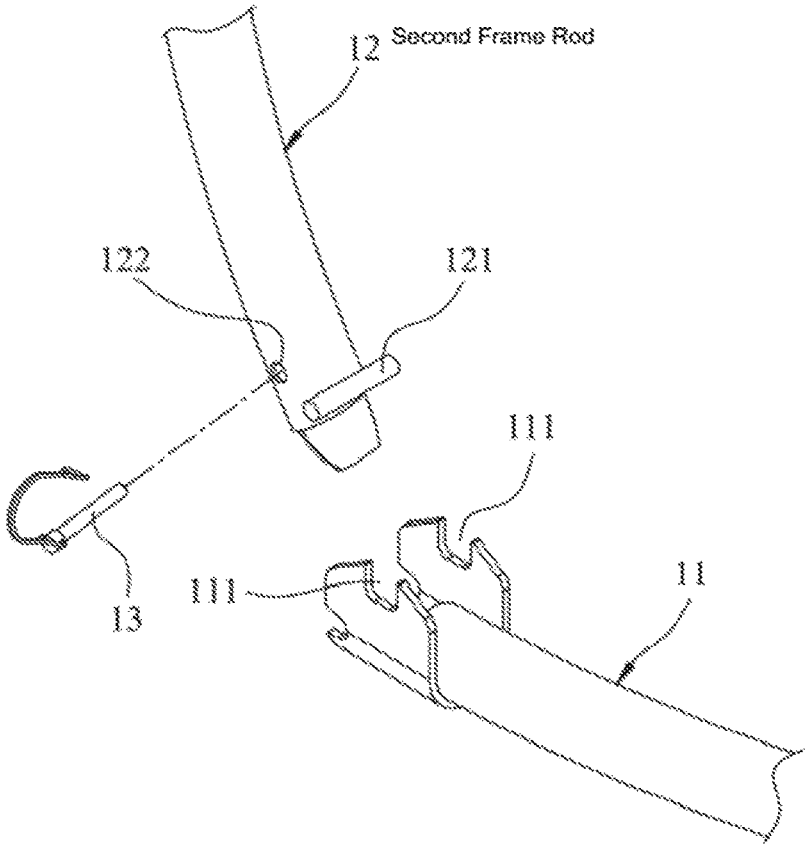
FIG. 1 (Prior Art)
FIG. 1 is prior art partial exploded view, illustrating the corresponding positions of a pivot connection groove, a pivot, a locating assembly and a locating hole.
Figure 2:
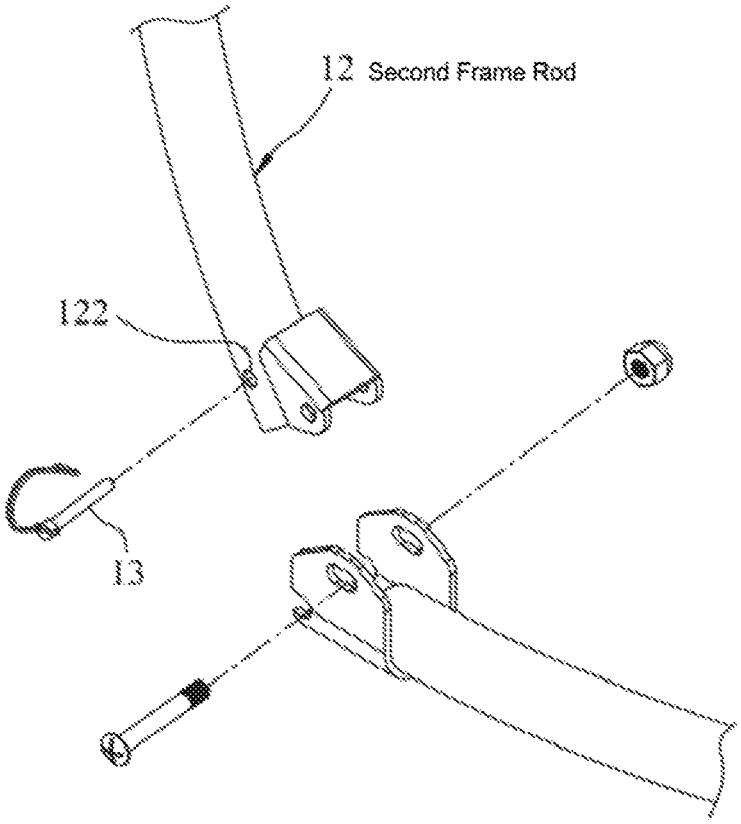
FIG. 2 (Prior Art)
FIG. 2 is a prior art partial exploded-view, indicating the corresponding positions of a locating assembly and a locating hole.
Figure 3:
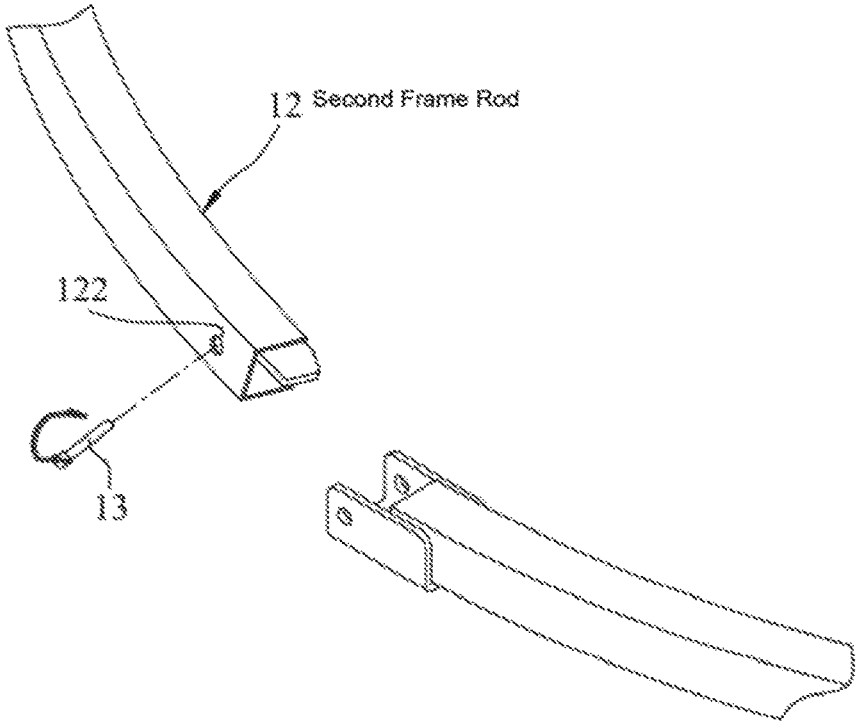
FIG. 3 (Prior Art)
FIG. 3 is an incomplete exploded-view drawing of the prior art, illustrating the corresponding positions of a locating assembly and a locating hole.

The following call out list of elements can be a useful guide for referencing the element numbers of the drawings.

11 First frame rod
111 Pivot connection groove
12 Second frame rod
121 Pivot
122 Locating hole
13 Locating assembly
200 Frame unit
20 First frame rod
21 First end
22 Retaining plate
221 End face
222 Clamping groove
223 Undersurface
224 Pivot connection groove
225 Stop groove
226 Stop block
227 Plate side
228 Upper groove wall
229 Lower groove wall
230 Groove sidewall
30 Second frame rod
31 Second end
32 Bottom edge
33 Pivot
34 Auxiliary support
35 Stopper
36 Locating hole
37 Threading slot
40 Locating assembly
41 Rod
42 Fixture block
43 Bumper
50 Support rod base
51 Joint pipe
52 Leg
600 Trampoline bed
60 Mesh
70 Fitting
80 Separate connector
X Circumferential Direction
110 Trampoline Frame
115 Trampoline Frame Ring
116 Trampoline Frame Leg
120 Trampoline Bed
130 Enclosure Pole
131 Enclosure Pole Connector
132 Trampoline Frame Hinge Joint
133 Upper Enclosure Support
134 Pin
135 Pin Receiving Opening
136 Knob
137 Spring Cover Strap

DETAILED DESCRIPTION OF THE PREFERRED EMBODIMENT

Figure 4:
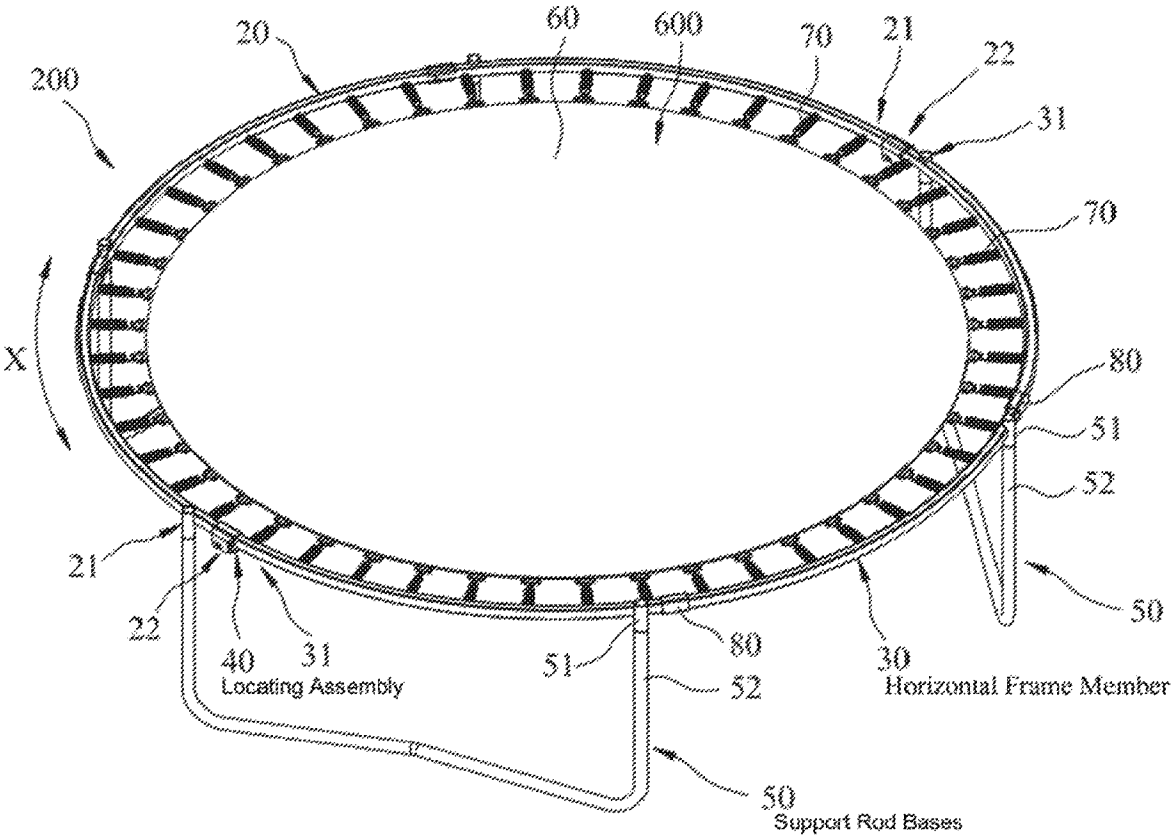
FIG. 4 is a diagram of an embodiment of the trampoline with folding frame in the present invention, demonstrating the combination relationship between a frame unit and a trampoline bed.
Figure 5:
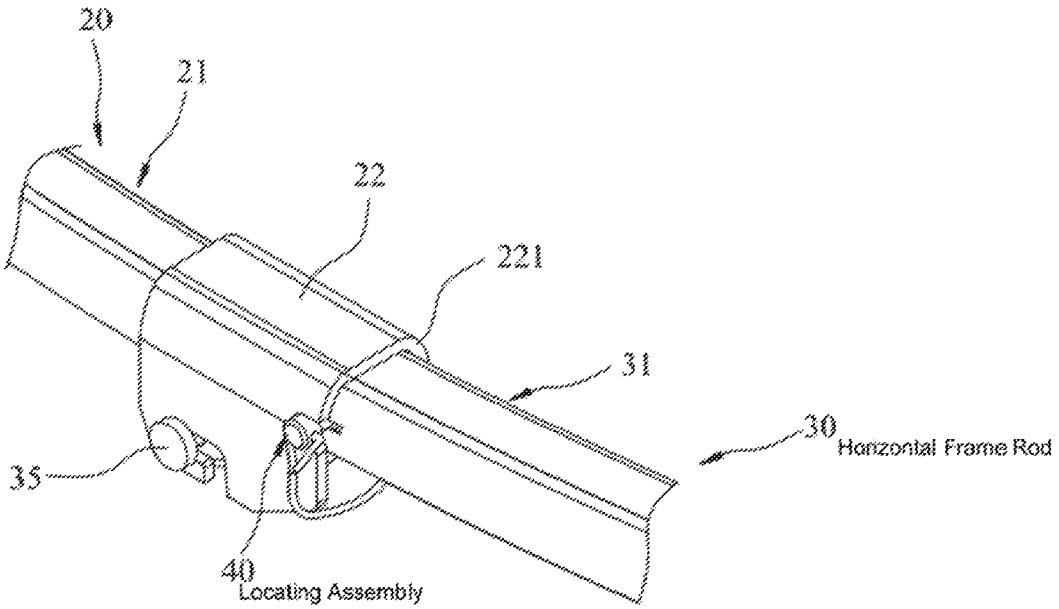
FIG. 5 is an incomplete partial enlarged diagram of an embodiment of the present invention, indicating the status where the first frame rod and the second frame rod is fixed by a locating unit.
Figure 6:
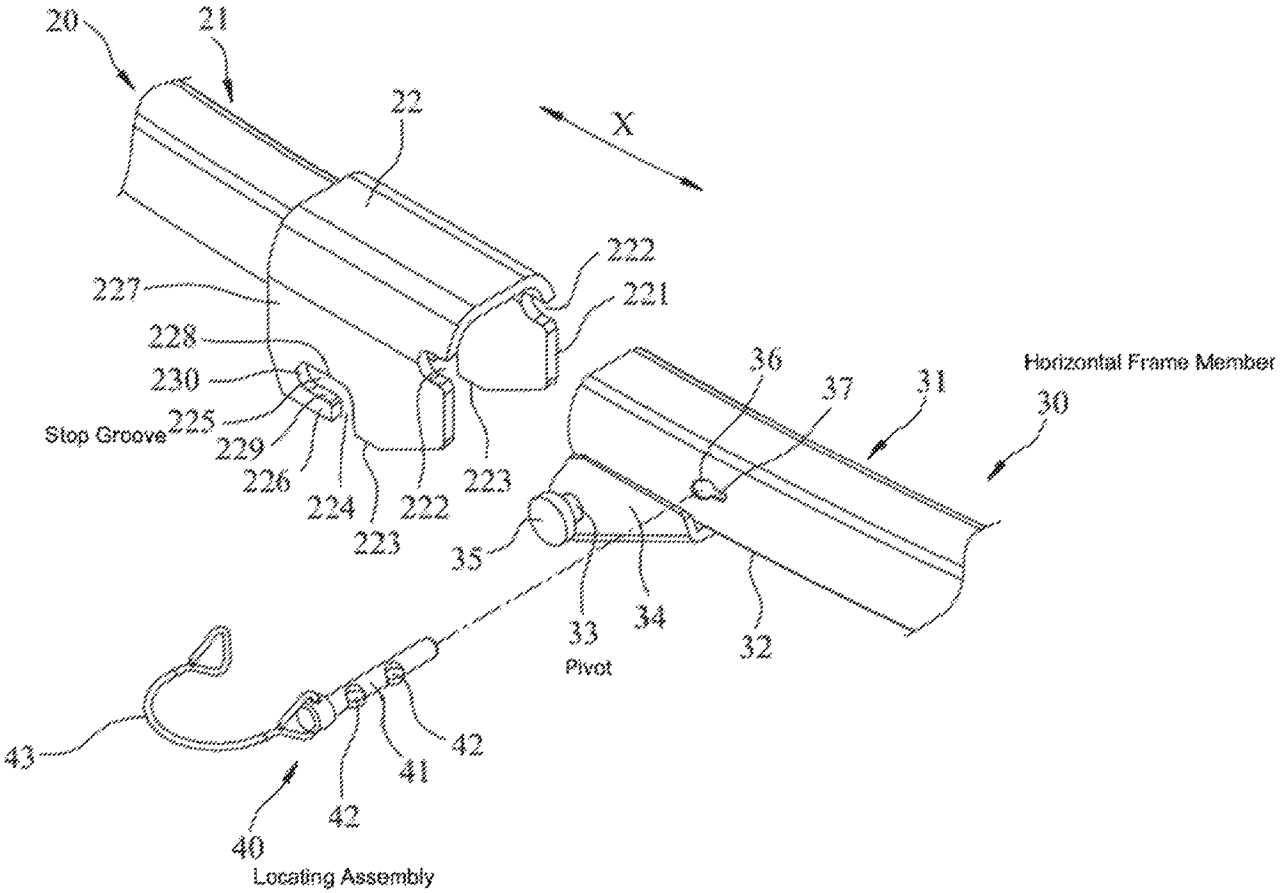
FIG. 6 is an incomplete partial exploded-view drawing of an embodiment of the present invention, illustrating the corresponding positions of a pivot connection groove, a stop groove, a pivot, a locating hole and a locating assembly.

As is indicated in FIGS. 4, 5 and 6, an embodiment of the trampoline with folding frame in the present invention includes a frame unit 200, and a trampoline bed 600. The frame unit 200 includes a first frame rod 20, a second frame rod 30 which is connected to the first frame rod 20 in a hollow ring shape, two locating assemblies 40 which can pass the joint of the first and the second frame rods 30, multiple support rod bases 50 where the first and the second frame rods 30 extend downwardly, and multiple separate connectors 80 which are respectively equipped in the outer periphery of the first frame rod 20 and the second frame rod 30. The first frame rod 20 extends circularly and includes two first ends 21 set opposite and two retaining plates 22 respectively mounted on the first ends 21.

Each retaining plate 22 has an end face 221 formed in the front, two clamping grooves 222 which depress towards the end faces 221 and extend circularly, multiple undersurfaces 223 which respectively intersect with the end faces 221 and are located at the bottom, two pivot connection grooves 224 which depress towards each undersurface 223 and two stop grooves 225 where one end of each pivot connection groove 224 and away from the end face 221 extends circularly, many stop blocks 226 which are located in the corresponding undersurfaces 223, pivot connection grooves 224 and stop groove 225, and multiple plate sides 227 which are respectively located at both sides and correspond to the pivot connection grooves 224 and the stop grooves 225.

Each stop groove 225 has an upper groove wall 228 corresponding to the undersurface 223, a lower groove wall 229 set opposite to the upper groove wall 228 and a groove sidewall 230 situated between the upper groove wall 228 and the lower groove wall 229. In the present embodiment, the cross-section of each retaining plate 22 is in an inverted U-shape, and is fixed downward to the first end 21. However, retaining two plates to both sides of the corresponding first end 21 can achieve the same effects as well.

The second frame rod 30 extends circularly and includes: two second ends 31 set opposite, two bottom edges 32 respectively formed at the bottom of the second end 31, two pivots 33 which are respectively connected to the bottom edges 32 and nested in the stop grooves 225 via the corresponding pivot connection grooves 224, two auxiliary supports 34 whose two ends are respectively connected to the corresponding bottom edges 32 and pivots 33, many stoppers 35 formed at two ends of each pivot 33, multiple locating holes 36 which respectively depress toward the second end 31 and are located at the corresponding two sides of the pivots 33 and many threading slots 37 that are connected to the corresponding locating holes 36. More specifically, each upper groove wall 228, lower groove wall 229 and groove sidewall 230 can press against the pivot 33 corresponding to the spacing. The pivots 33 and the locating holes 36 are configured in a radial direction that is perpendicular to the circumferential direction X.

Each locating assembly 40 includes a rod 41, multiple fixture blocks 42 that protrude and extend towards the outer periphery of the rod 41, and a bumper 43 in an arc shape. Each rod 41 and its corresponding fixture block 42 respectively respond to the threading slot 37. One end of each bumper 43 is connected to one side end of the corresponding rod 41, while the other end of each bumper 43 is detachably nested in the other side end of the corresponding rod 41. Specifically, the locating assembly 40 has the effect of automatically stop so that the first frame rod 20 and the second frame rod can press against and fix each other.

The support rod base 50 has many joint pipes 51 alternately equipped and connected to the outer periphery of the first and the second rods 20 and 30 and many legs 52 connected to the corresponding joint pipes 51. It should be noted that the joint pipes 51 are welded to the first and the second frame rods 20 and 30, and that each joint pipe 51 is equipped in the adjacent corresponding separate connector 80. The trampoline bed 600 is hung at this frame unit 200, and includes the mesh itself 60, multiple fittings 70 fixed around the mesh 60. The fittings 70 are connected to the first and the second frame rods 20 and 30.

Figure 7:
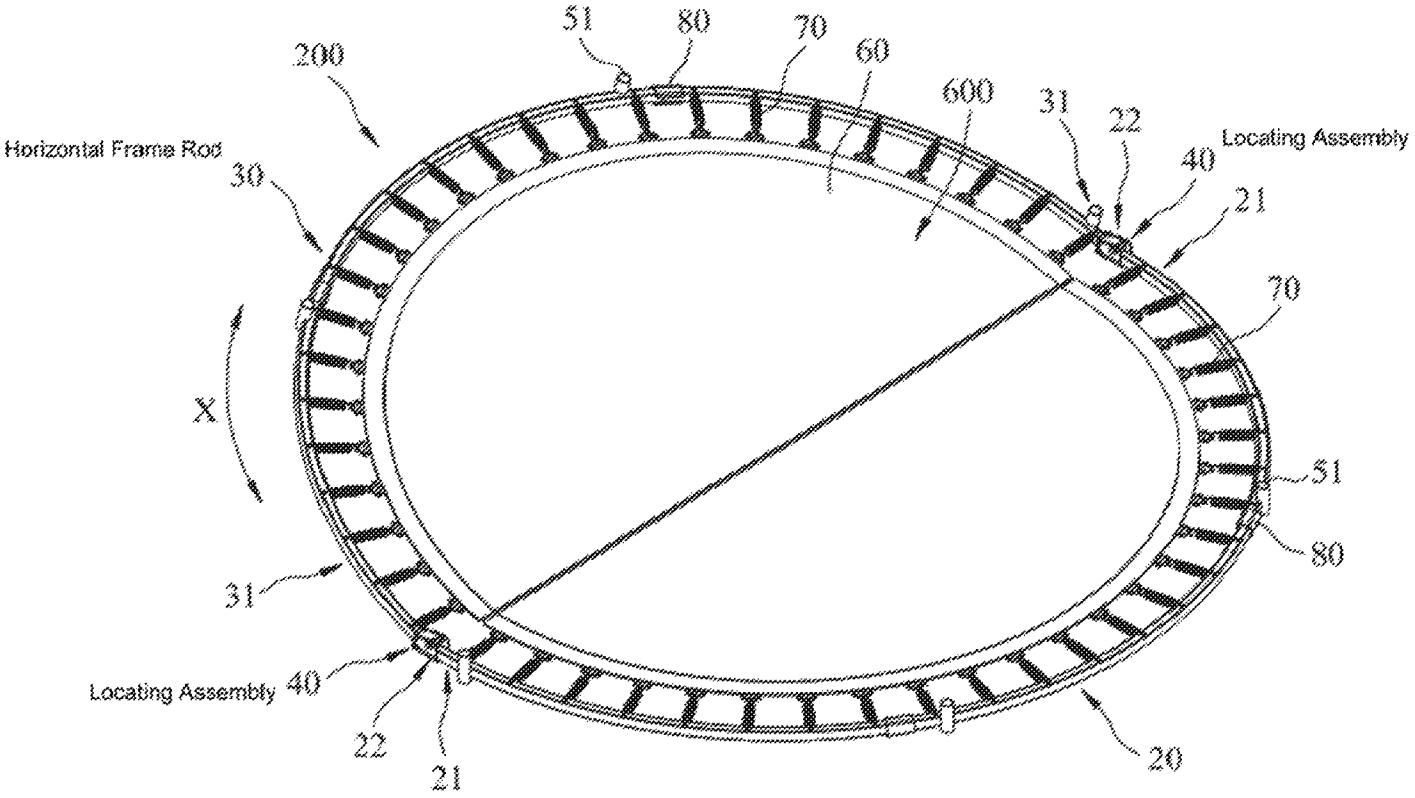
FIG. 7 is a diagram of an embodiment of the invention, suggesting the status where the second frame rod is unfolded and the first frame rod and the second frame rod are turned over.
Figure 8:
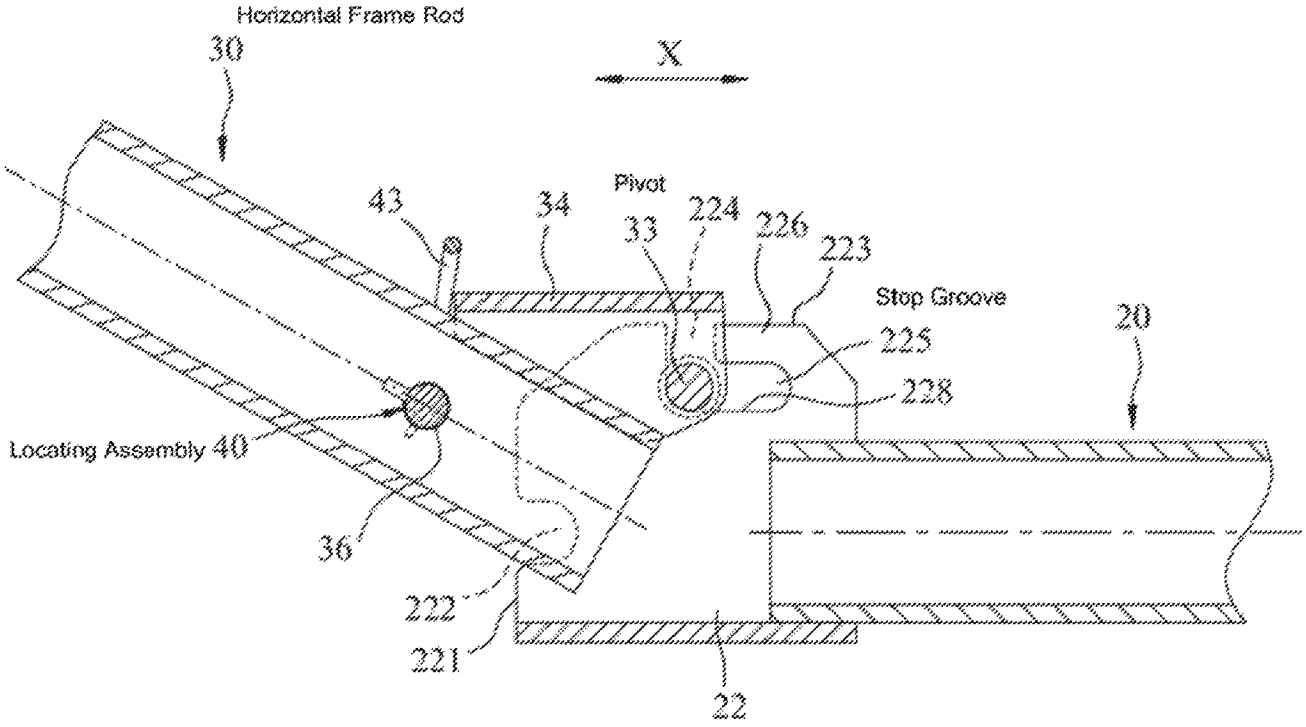
FIG. 8 is an incomplete partial section view of an embodiment of the present invention, suggesting the status where the second frame rod is located in this unfolded position and the locating hole and its corresponding clamping groove are staggered.
Figure 9:
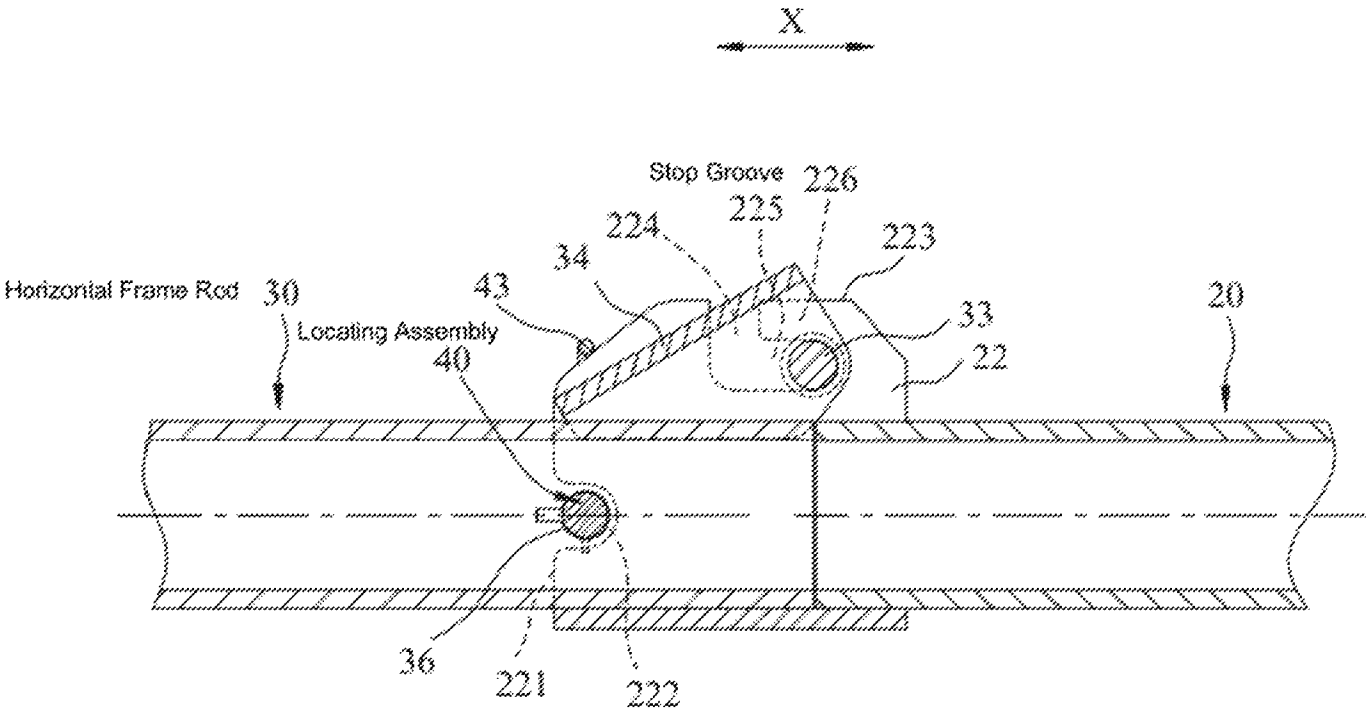
FIG. 9 is an incomplete partial section view of an embodiment of the present invention, illustrating the status where the locating hole and its corresponding clamping groove are apposed.
Figure 10:
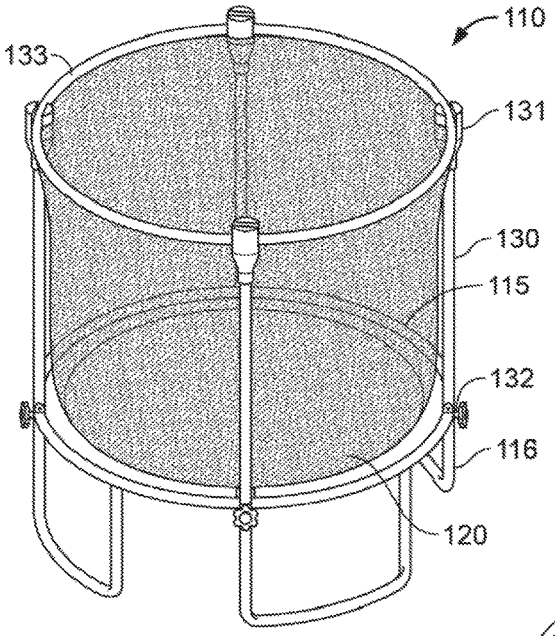
FIG. 10 is a diagram of the assembled trampoline in upright configuration.
Figure 11:
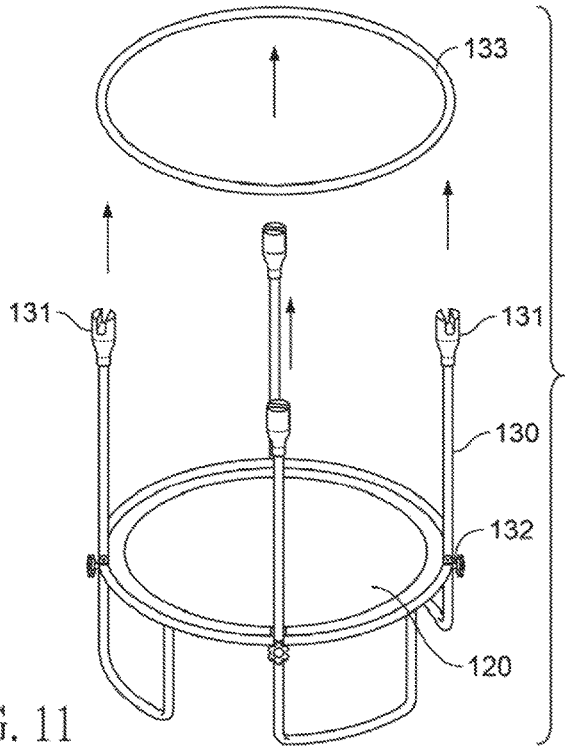
FIG. 11 is a diagram of the trampoline being disassembled.
Figure 12:
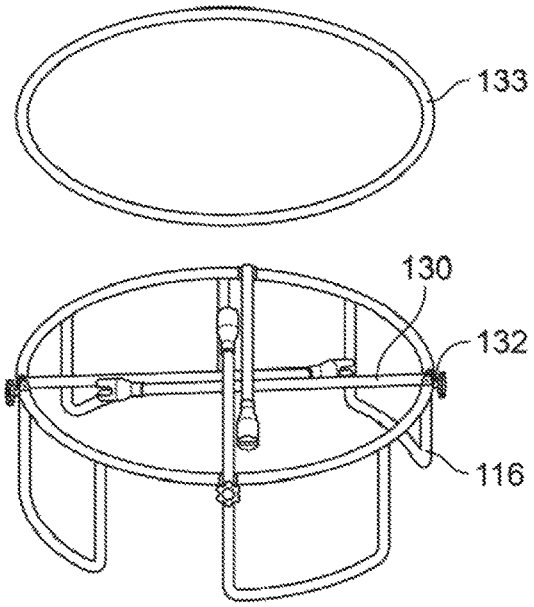
FIG. 12 is a diagram of the trampoline being disassembled.
Figure 13:
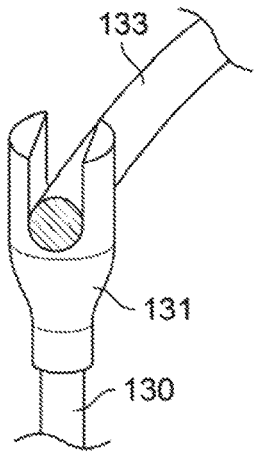
FIG. 13 is a diagram of the enclosure pole connector.
Figure 14:
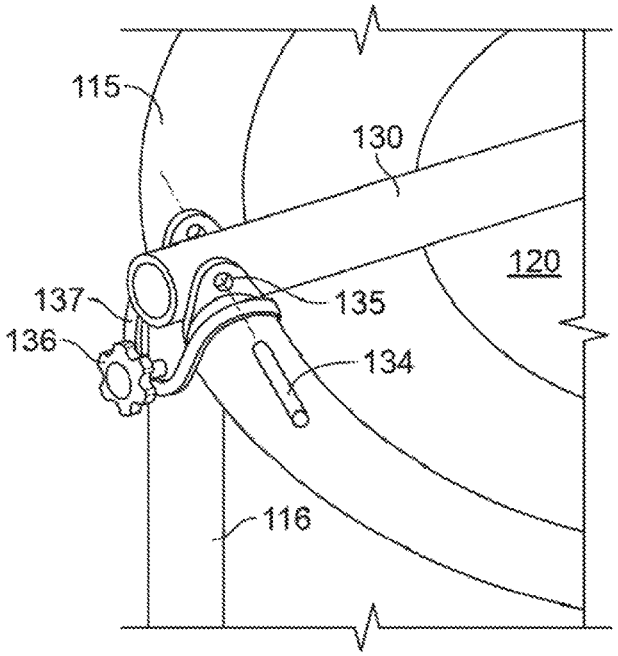
FIG. 14 is a diagram of the folding trampoline enclosure pole.

As is shown in FIGS. 7, 8 and 9, to facilitate storage and transport, in this embodiment, the first frame rod 20 is generally separate from the second frame rod 30 in order to save space. When this embodiment is unfolded and used, it is first turned over to the back, the locating assembly 40 is first inserted into the corresponding locating hole 36, and then the pivot 33 is clamped to the corresponding pivot connection groove 224. Next, the second frame rod 30 is pressed downward from an unfolded position where the locating hole 36 and the corresponding clamping groove 222 are staggered (FIG. 8) to the front of the corresponding clamping groove 222 of the locating assembly 40. Next, the pivot 33 is moved circularly to the corresponding stop groove 225 so that the second frame rod 30 is operated to a folded position (FIG. 9) where the locating hole and its corresponding clamping groove are apposed.

Specifically, when the second frame rod 30 is located in this folded position, the locating assemblies 40 are respectively inserted into the corresponding locating holes 36 and the clamping grooves 222, and the pivots 33 are clamped to the corresponding stop grooves and is pressed against and stopped by the stop blocks 226. When operation is conducted between the unfolded position and the folded position, the stopper 35 can press against the corresponding plate side 227 (FIG. 6), thereby preventing the pivot 33 from moving perpendicularly to the circular direction when the second frame rod 20 operates between the unfolded position and the folded position.

In conclusion, the present invention provides a trampoline with folding frame that includes a frame unit. In the prior art, force needs to be applied to ensure the second frame rod is located in this folded position before the locating assemblies 40 can be inserted into the corresponding locating holes 36. In contrast, in the present embodiment, before unfolding, the locating assemblies 40 are first inserted into the corresponding locating holes 36, and then after the pivot 33 is clamped to the corresponding pivot connection groove 224, the second frame rod 30 is operated from the unfolded position where the locating hole 36 and the corresponding clamping groove 222 are staggered to the folded position where the locating hole 36 and the corresponding clamping groove 222 are apposed in order to complete the unfolding action. The danger caused by exerting a force on the folded position for a long time can be avoided so as to enhance the operational safety of the device.

The trampoline also has an enclosure that folds down. The trampoline has a trampoline frame 110 which supports the trampoline bed 120. The trampoline frame 110 has a trampoline frame ring 115 that is substantially horizontally oriented for supporting the trampoline bed 120 in a horizontal position. The trampoline frame ring 115 is supported by one or more of the trampoline frame legs 116.

The trampoline frame ring 115 also includes trampoline frame hinge joints 132. The hinge joints 132 allow the enclosure poles 132 fold-down after the upper enclosure support 133 has been removed. The enclosure poles fold inward at an angle normal to the trampoline frame ring 115.

The enclosure poles 132 are hinged to the trampoline frame ring 115 at the trampoline frame hinge joints 132. The enclosure poles 132 are independent and cross over each other when the trampoline enclosure is in stowed configuration. The enclosure poles 132 fold inward when the enclosure is in stowed configuration and fold upward to an upright position when the enclosure is in the deployed position.

The enclosure pole connectors can be formed as sockets having a slot for receiving the upper enclosure support 133. The upper enclosure support 133 can be formed as a horizontally suspended ring made of metal, plastic or fiberglass. The upper enclosures for 133 can be formed as segments of a plurality of connected rods. The hinge joint 132 can be stabilized by a pin 134 that is inserted into a pin receiving opening 135 on the hinge joint 132 to keep the enclosure pole 130 in upright position. The pin 134 preferably passes through the enclosure poles which are formed as hollow metal tubes. The hinge joint can also have a pair of flanges that have openings for the pin receiving opening 135. The pin 134 receiving opening 135 passes through the pair of flanges and the enclosure pole for locking them together. The pin 134 receiving opening 135 and the pin 134 can be threaded for additional tightness and security and to avoid wobble.

A knob 136 can be formed on the trampoline frame leg 116 at the junction of the trampoline frame leg 116 and the trampoline frame ring 115. The knob 136 can be connected to a bolt that bolts or connects the trampoline frame leg to the trampoline frame ring 115. The knob 136 is located below the level of the trampoline frame ring 115, but can also provide the same function as the pin 134 if the knob 136 is at least partially connected to a portion of the trampoline enclosure pole.

A spring cover strap 137 can be formed as a loop that has an opening that fits over the knob 136. The spring cover strap 137 loop ends are connected to the spring cover. The spring cover covers the springs. The spring cover can be a sheet of plastic or can have a thicker expanded foam padding. Trampoline pads can have straps that loop over the head of the knob 136. The trampoline pads traps can be formed of fabric or cord the as rope. The trampoline pads are typically placed along a circumferential periphery of the trampoline frame ring 115. Trampoline pads can have an elastic strap for the spring cover strap 137 that fits over the head of the knob 136.

The invention claimed is:

1. A trampoline with a folding frame comprising: a frame supporting a bed tensioned by springs across the frame, a horizontal frame, and multiple support rod bases; the horizontal frame member formed as a frame unit, wherein the frame unit has a first frame rod and a second frame rod, wherein the first and second frame rods extend horizontally and the first frame rod has a first end and a second end and the second frame rod has a first end and a second end, wherein the first frame rod connects to the second frame rod such that the first end of the first frame rod is pivotally connected to the first end of the second frame rod through a first joint and the second end of the first frame rod is pivotally connected to the second end of the second frame rod through a second joint; wherein each of the first and second joints comprise a retaining plate, two clamping grooves, two pivot connection grooves, a first stop groove, a second stop groove, two pivots, a locating hole and a locating assembly, wherein the retaining plate is mounted to the first frame rod at a respective end of the first and second ends, wherein the retaining plate has a pair of plate sides, wherein the pair of plate sides extend downwardly from the retaining plate, wherein the retaining plate has an end face formed toward the respective end of the first and second ends of the first frame rod, each of the two clamping grooves are formed on a respective pair of plate sides of the retaining plate, the two pivot connection grooves extend upwardly into a pair of undersurfaces, wherein each of the pair of undersurfaces are formed on a respective lower surface of the pair of plate sides of the retaining plate, the first stop groove extending laterally from a first pivot connection groove of the two pivot connection grooves formed in one of the pair of plate sides of the retaining plate, and a second stop groove extending laterally from a second pivot connection groove of the two pivot connection grooves formed in another of the pair of plate sides of the retaining plate, the two pivots mounted on the second frame rod and configured to respectively engage the first and second stop grooves; and the locating hole formed on the second frame rod at a side of the second frame rod, wherein the locating hole k configured to receive the locating assembly that engages the two clamping grooves.

2. The trampoline with the folding frame of claim 1, wherein each of the retaining plates of the first and second joints have stop block formed on each of the lower surfaces of the pair of plate sides, wherein each of the stop hocks define a portion of a respective stop groove of the first and second stop grooves of the retaining plates and, wherein each of the first and second stop grooves has an upper groove wall, wherein a lower groove wall is set opposite to the upper groove wall and wherein a groove sidewall is configured between the upper groove wall and the lower groove wall, wherein each of the stop blocks is Formed below the lower groove wall, and wherein each of the upper groove wall, the lower groove wall, and the groove sidewall are load bearing.

3. The trampoline with the folding frame of claim 2, wherein the second frame rod further includes two auxiliary supports, wherein the two auxiliary supports are connected to corresponding auxiliary support bottom edge and auxiliary support pivots and wherein each of the two auxiliary supports is connected to a respective end of the first and second end of the second frame rod.

4. The trampoline with the folding frame of claim 3, wherein each of the pair plate sides of the retaining plates of the First and second joints are parallel to each other.

5. The trampoline with the folding frame of claim 4, wherein each of the first and second ends of the second frame rod further include a threading slot connected to the locating hole, wherein each of the locating assemblies comprise a rod and a fixture block that protrudes and extend towards an outer periphery of the rod, wherein the rod and the fixture block are configured to be inserted into the threading slot.

6. The trampoline with the folding frame of claim 5, wherein each of the locating assemblies of the first and second joints further comprise a bumper in an arc shape, wherein an end of the bumper is connected to a first side end of the rod, while the other end of the bumper is detachably nested in a second side end of the rod.

7. The trampoline with the folding frame of claim 6, wherein a cross-section of each of the retaining plates of the first and second joints are an inverted U-shape.

8. The trampoline with the folding frame of claim 7, wherein the multiple support rod bases each have a pair joint pipes connected to an outer periphery of the first frame rod and the second frame rod and a leg connected to each of the pair of joint pipes.

9. The trampoline with the folding frame of claim 8 wherein the pair of joint pipes are welded to the first frame rod and the second frame rod.

* * * * *